US006401392B1

(12) United States Patent
Yuge

(10) Patent No.: US 6,401,392 B1
(45) Date of Patent: Jun. 11, 2002

(54) POWER OPERATING APPARATUS FOR VEHICLE DOOR

(75) Inventor: Masaaki Yuge, Yokohama (JP)

(73) Assignee: Ohi Seisakusho Co., Ltd., Yokohama (JP)

( * ) Notice: Subject to any disclaimer, the term of this patent is extended or adjusted under 35 U.S.C. 154(b) by 0 days.

(21) Appl. No.: 09/537,514

(22) Filed: Mar. 29, 2000

(30) Foreign Application Priority Data

May 26, 1999 (JP) ..... 11-146363

(51) Int. Cl.[7] ..... E05F 15/10

(52) U.S. Cl. ..... 49/340; 49/346; 49/354; 296/54

(58) Field of Search ..... 49/340, 341, 342, 49/343, 344, 345, 346, 354, 355, 359; 296/56, 146.4, 146.8

(56) References Cited

U.S. PATENT DOCUMENTS

| | | | | | |
|---|---|---|---|---|---|
| 3,343,303 | A | * | 9/1967 | Wanlass | 296/56 |
| 3,713,472 | A | * | 1/1973 | Dozois | 160/189 |
| 5,035,463 | A | * | 7/1991 | Kato et al. | 296/223 |
| 5,054,239 | A | * | 10/1991 | Tucker et al. | 49/279 |
| RE36,267 | E | * | 8/1999 | Moore et al. | 49/340 |
| 5,966,871 | A | * | 10/1999 | Tsuda et al. | 49/324 |
| 6,006,475 | A | * | 12/1999 | Schwantes et al. | 49/341 |
| 6,055,775 | A | * | 5/2000 | Dering et al. | 49/340 |
| 6,055,776 | A | * | 5/2000 | Dettling et al. | 49/341 |
| 6,092,337 | A | * | 7/2000 | Johnson et al. | 49/340 |
| 6,142,551 | A | * | 11/2000 | Ciavaglia et al. | 296/56 |
| 6,181,094 | B1 | * | 1/2001 | Menke | 318/434 |
| 6,202,350 | B1 | * | 3/2001 | Montgomery et al. | 49/139 |

FOREIGN PATENT DOCUMENTS

| | | |
|---|---|---|
| DE | 195 44 781 A1 | 11/1995 |
| DE | 197 34 320 C2 | 8/1997 |
| DE | 198 46 764 A1 | 10/1998 |
| JP | 6-71852 | 10/1994 |
| JP | 2561335 | 10/1997 |

* cited by examiner

*Primary Examiner*—Curtis A. Cohen
(74) *Attorney, Agent, or Firm*—Foley & Lardner

(57) ABSTRACT

A power operating apparatus for a vehicle door moveable between an opened position and a closed position, includes a drive mechanism provided at the inside of a vehicle body with respect to a door opening of the vehicle door to power move the vehicle door in an opening direction toward the opened position and in a closing direction toward the closed position, and a power-transmission mechanism mechanically linking the drive mechanism with the vehicle door to enable power transmission between the drive mechanism and the vehicle door. A through-opening in the body panel of the vehicle body so that the through-opening is arranged outside of the inner peripheral edge of the door opening. The power-transmission mechanism having at least a linkage portion capable of going into and out of the interior of the vehicle body. The linkage portion of the power-transmission mechanism is inserted into the through-opening, so that the locus of power movement of the linkage portion is generated outside of the inner peripheral edge of the door opening.

11 Claims, 7 Drawing Sheets

POWER OPERATING APPARATUS FOR VEHICLE DOOR

BACKGROUND OF THE INVENTION

1. Field of the Invention

The present invention relates to a power operating apparatus for a vehicle door moveable between a closed position and an opened position, and specifically to a power operating apparatus suitable for an electrically powered, hinged back door.

2. Description of the Prior Art

As is generally known, a van, a wagon, or the like has usually a comparatively large hinged back door, a comparatively large hinged rear gate, or a comparatively large hinged tail gate, to form a wide door opening at the rear of the vehicle. Such a hinged back door (or a hinged rear gate or a hinged tail gate) can be opened upwards by way of upward pivotal movement about door hinges or closed downwards by way of downward pivotal movement about the door hinges. For the purpose of laborsaving, it is generally known to provide an electrically-driven vehicle door for a van or a wagon, in which the door is opened and closed by operation of a drive mechanism having a reversible electric motor. Such electrically-driven vehicle doors have been disclosed in Japanese Utility-Model Provisional Publication No. 5-52165 (already registered on Oct. 17, 1997 as a registration No. 2561335) and Japanese Utility-Model Provisional Publication No. 6-71852. In the power operating apparatus disclosed in the Japanese Utility-Model Provisional Publication Nos. 5-52165 and 6-71852, the electric drive means (the motor drive mechanism) is provided at the inside of the vehicle. Power produced by the drive mechanism is transmitted through a power-transmission member (or a power-transmission linkage) to a back door, so as to open or close the back door. In the Japanese Utility-Model Provisional Publication No. 5-52165, a cable (or a wire) is used as a power-transmission member. On the other hand, in the Japanese Utility-Model Provisional Publication No. 6-71852, a linkage, composed of a rod and an arm member, is used as a power-transmission member. In the prior-art vehicle door operating apparatus disclosed in the Japanese Utility-Model Provisional Publication Nos. 5-52165 and 6-71852, the power-transmission members, that is, the force-transmission cable and the power-transmission linkage (composed of a rod and an arm member) are commonly arranged along the inside of an inner peripheral edge of the door opening for the back door. The vehicle-door opening serves as a useful space for cargo work (a loading-and-unloading space). The wider an opening area of the door opening, the higher a work efficiency. However, in the previously-described prior-art vehicle door operating apparatus, the power-transmission member or the power-transmission linkage is arranged along the inside body panel (the body-panel inside wall) and along the inside of the inner peripheral edge of the door opening so that part of the luggage space (or baggage space) is occupied by the power-transmission member. As a result of this, the effective door-opening area is reduced undesiredly, thus lowering the work efficiency during loading and unloading through the door opening.

SUMMARY OF THE INVENTION

Accordingly, it is an object of the invention to provide a power operating apparatus for a vehicle door, which avoids the aforementioned disadvantages of the prior art.

It is another object of the invention to provide a convenient, compact power operating apparatus for a vehicle door, which is capable of reducing the burden of opening and closing the vehicle door by power movement of the vehicle door, and of realizing easy loading and unloading through a door opening having as wide an effective door-opening area as possible and of enhancing a work efficiency by a drive-mechanism plus power-transmission mechanism compactly mounted on the inside of the body panel.

In order to accomplish the aforementioned and other objects of the present invention, a power operating apparatus for a vehicle door moveable between an opened position and a closed position comprises a drive mechanism provided at an inside of a vehicle body with respect to a door opening of the vehicle door to power move the vehicle door in an opening direction toward the opened position and in a closing direction toward the closed position, a power-transmission mechanism mechanically linking the drive mechanism with the vehicle door to enable power transmission between the drive mechanism and the vehicle door, means for defining a through-opening in a body panel of the vehicle body so that the through-opening is arranged outside of an inner peripheral edge of the door opening, and the power-transmission mechanism having at least a linkage portion capable of going into and out of an interior of the vehicle body, wherein the linkage portion of the power-transmission mechanism is inserted into the through-opening, so that a locus of power movement of the linkage portion of said power-transmission mechanism is generated outside of the inner peripheral edge of the door opening. It is preferable that the linkage portion of the power-transmission mechanism is curved with a predetermined curvature in a longitudinal direction of the linkage portion, and contoured and dimensioned so that a centroid of the linkage portion, extending in the longitudinal direction, turns on a predetermined radius of curvature substantially corresponding to a distance between the centroid of the linkage portion and an axis of rotation for the vehicle door during power movement of the vehicle door. Preferably, a seal member may be provided along an inner periphery of the through-opening to prevent dust and moisture from entering the interior of the vehicle body through the through-opening. More preferably, a reinforcement may be provided along the inner periphery of the through-opening to partly enhance the rigidity of the body panel at and near the through-opening. The drive mechanism may have a slider disposed in the interior of the vehicle body and an electric motor initiating a reciprocating motion of the slider, and the power-transmission mechanism may have a link rotatably connected at one link end to the slider, and an arm rotatably connected at one arm end to another link end of the link and fixedly connected at another arm end to the vehicle door, and the arm substantially corresponds to the linkage portion of the power-transmission mechanism, capable of going into and out of the interior of the vehicle body. It is preferable that the drive mechanism is mounted on the inner peripheral wall of a roof panel of the vehicle body.

According to another aspect of the invention, a power operating apparatus for a hinged back door moveable between an opened position and a closed position comprises an electric drive mechanism provided at an inside of a vehicle body with respect to a door opening of the back door and including an electric motor selectively energizable to power move the back door in an opening direction toward the opened position and in a closing direction toward the closed position, a power-transmission mechanism mechanically linking the drive mechanism with the back door to enable power transmission between the drive mechanism and the back door, means for defining a through-opening in an inner body panel and an outer body panel of the vehicle body near the intersection between an upper roof rail portion and a rear pillar drip rail portion so that the through-opening is arranged outside of an inner peripheral edge of the door opening, and the power-transmission mechanism having at least a linkage portion capable of going into and out of an interior of the vehicle body, wherein the linkage portion of the power-transmission mechanism is inserted into the through-opening, so that a locus of power movement of the linkage portion of said power-transmission mechanism is generated outside of the inner peripheral edge of the door opening. It is preferable that the linkage portion of the power-transmission mechanism is curved with a predetermined curvature in a longitudinal direction of the linkage portion, and contoured and dimensioned so that a centroid of the linkage portion, extending in the longitudinal direction, turns on a predetermined radius of curvature substantially corresponding to a distance between the centroid of the linkage portion and an axis of rotation for the back door during power movement of the back door to minimize an opening area of the through-opening. Preferably, the through-opening may have an outwardly flanged portion slightly extending outwards from an inner periphery of the through-opening, and a seal member is fitted onto the outwardly flanged portion to prevent dust and moisture from entering the interior of the vehicle body through the through-opening. It is more preferable that a reinforcement is provided along an inner periphery of the through-opening to partly enhance the rigidity of the inner and outer body panels at and near the through-opening, and the inner body panel has an elliptical slot and the outer body panel has an elliptical slot, the reinforcement is formed as a substantially cylindrical reinforcement connecting the elliptical slot of the inner body panel with the elliptical slot of the outer body panel. The means for defining the through-opening may comprise the elliptical slot formed in the inner body panel, the elliptical slot formed in the outer body panel, and the substantially cylindrical reinforcement, and thus the substantially cylindrical reinforcement serves as a guide sleeve for the linkage portion of the power-transmission mechanism.

DESCRIPTION OF THE PREFERRED EMBODIMENTS

Figure 1:
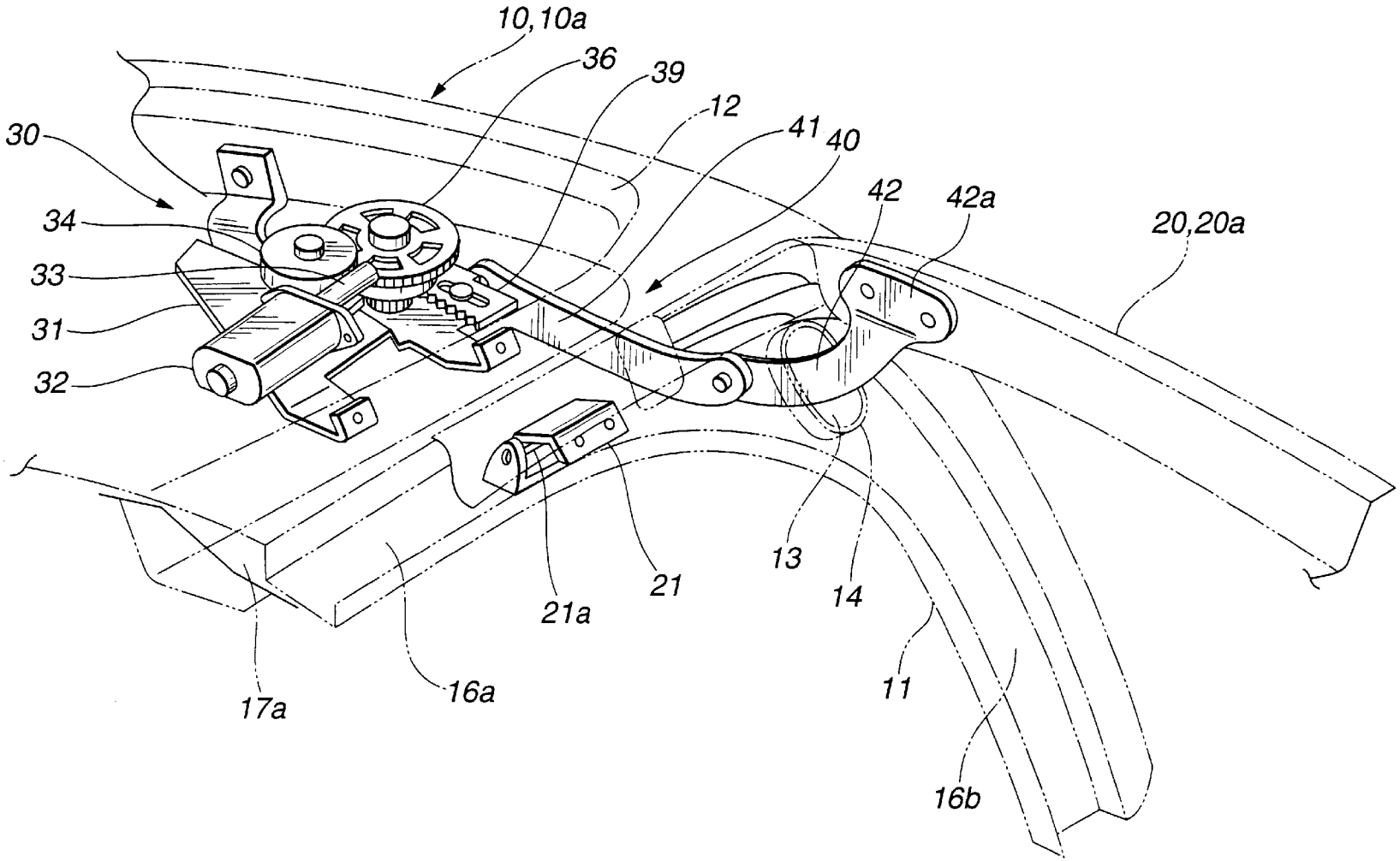
FIG. 1 is a perspective view illustrating a rear-right end of a vehicle showing a power door operating apparatus of an embodiment.

Referring now to the drawings, particularly to FIG. 1, the power vehicle-door operating apparatus of the embodiment is exemplified in an electrically powered back door 20 for a van or a wagon 10. As shown in FIG. 1, a door opening 11 is widely defined at the rear end of the vehicle body 10*a* of the wagon 10. The back door 20 is attached to the body panel at the rear end of the vehicle, such that the door opening 11 is opened by way of upward pivotal movement of the back door about door hinges 21 or closed by way of downward pivotal movement of the back door about the door hinges. In more detail, the back door 20 is hinged at the top, so that the top end of the back door 20 is attached pivotally to the rear upper roof drip rail portion 16*a* spot-welded on the rear lower roof rail portion 17*a* of the rear end of the roof panel 12. The power door operating apparatus of the embodiment includes a drive mechanism 30 and a power-transmission mechanism 40. The drive mechanism 30 is provided at the inside of the vehicle with respect to the door opening 11. Actually, the drive mechanism 30 is mounted on the inner peripheral wall of the roof panel 12 near at the rear end of the roof panel of the vehicle body 10*a*. It is advantageous to install the drive mechanism 30 on the inside wall of the roof panel 12, because it is possible to ensure as wide an effective floor area of the floor portion continuous with the door opening as possible, thus ensuring a wider luggage space in the interior of the vehicle body 10*a*. The power-transmission mechanism 40 mechanically links or connects an output member of the drive mechanism 30 with the back door 20 (driven member), for the purpose of power movement (power opening or closing) of the back door 20. Note that, in the power door operating apparatus of the embodiment, at least a part (which will be hereinafter referred to as a "going-in-and-out power-transmission linkage portion") of the power-transmission mechanism 40, capable of going into and out of the vehicle compartment (or the rear luggage space or the interior of the vehicle body), is arranged outside of the inner peripheral edge of the door opening 11. Additionally, the going-in-and-out power-transmission linkage portion is constructed, so that the going-in-and-out power-transmission linkage portion passes through or is inserted into a through-opening (or a linkage passage) 13 arranged outside of the inner peripheral edge of the door opening 11 and formed in the body panel of the vehicle body 10*a* (more exactly, the intersection between the rear upper roof drip rail portion 16*a* and the rear pillar drip rail portion 16*b* or the rear quarter panel), so that a locus of power movement of the going-in-and-out power-transmission linkage portion of the power-transmission mechanism is generated outside of the inner peripheral edge of the door opening.

Figure 6:
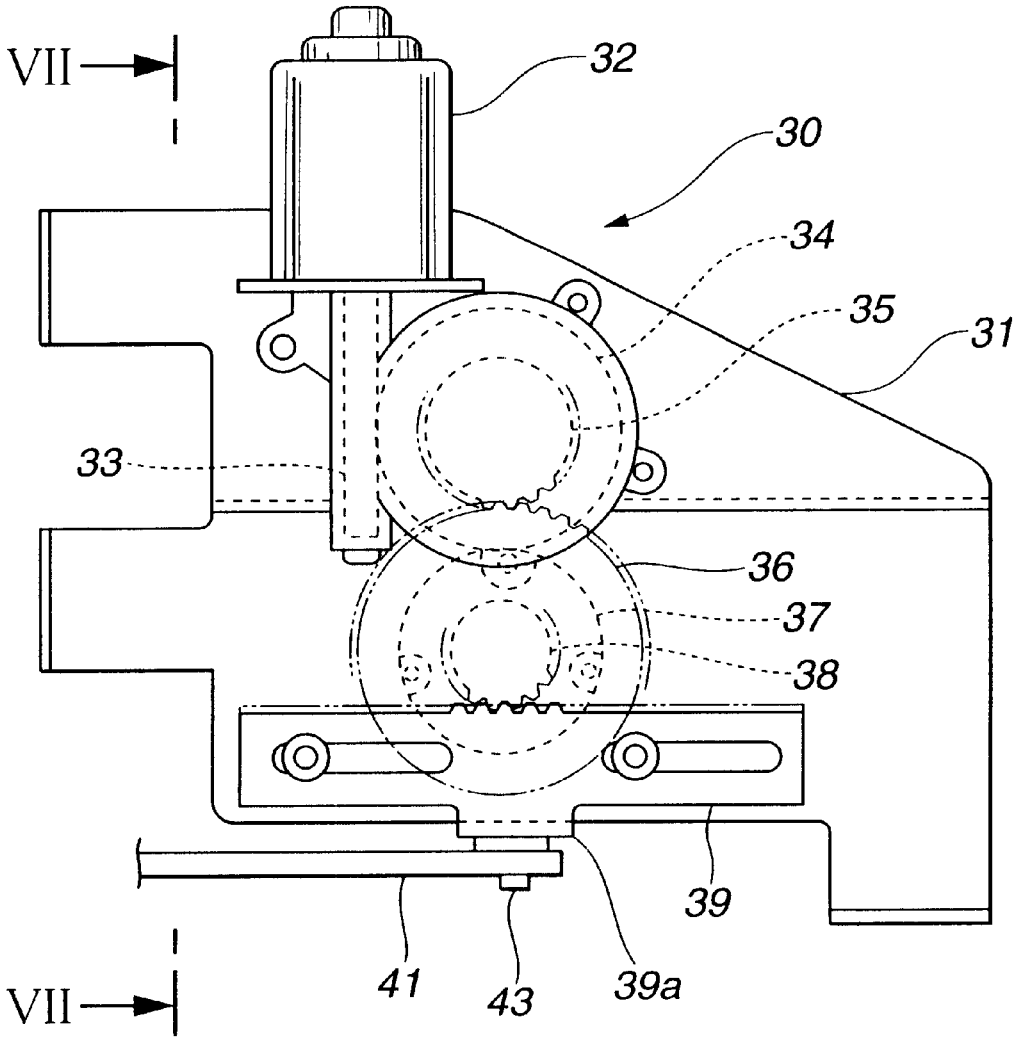
FIG. 6 is a plan view illustrating a drive mechanism included in the power door operating apparatus of the embodiment.
Figure 7:
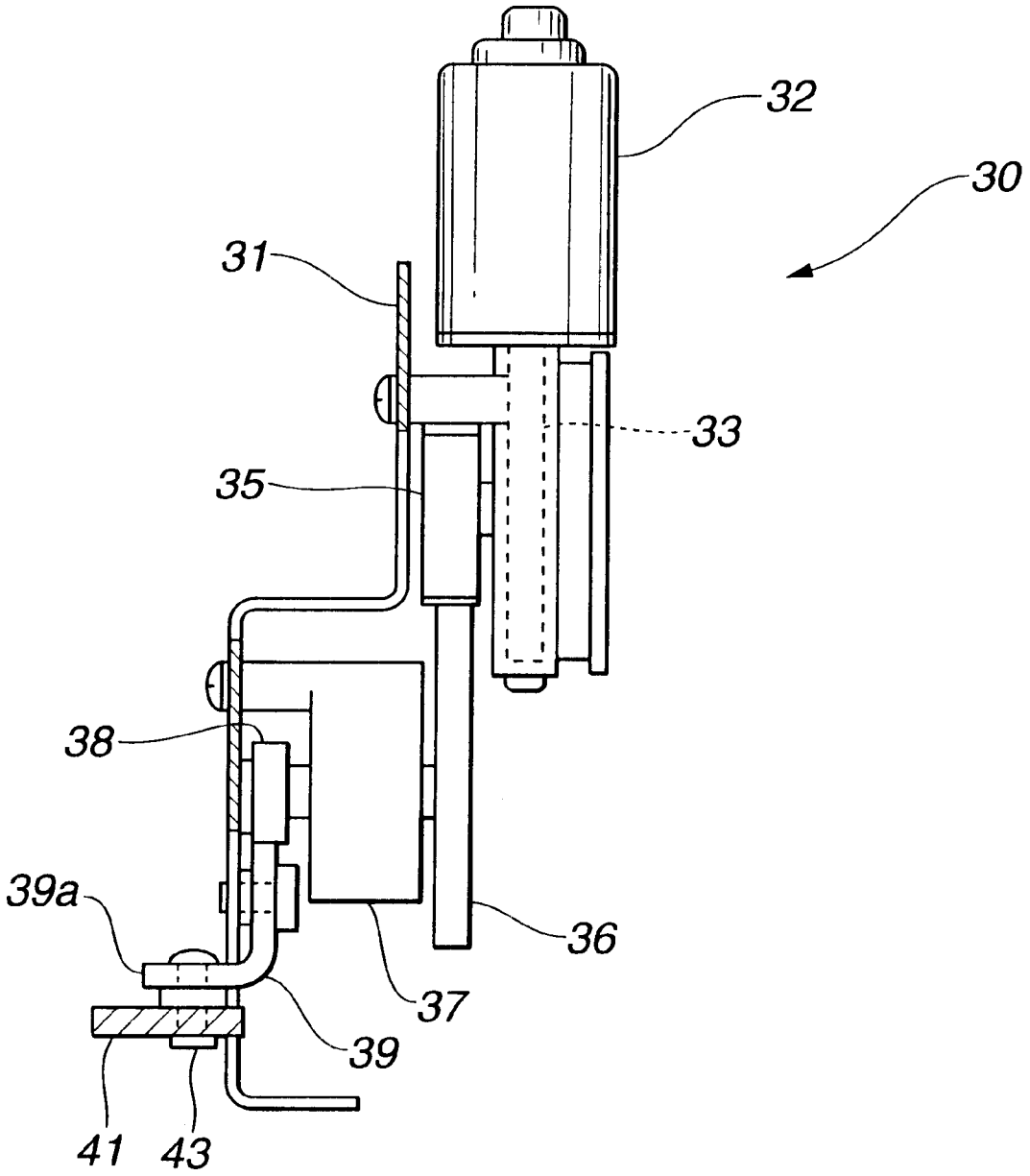
FIG. 7 is a cross-section taken along the line VII—VII of FIG. 6.
Figure 8:
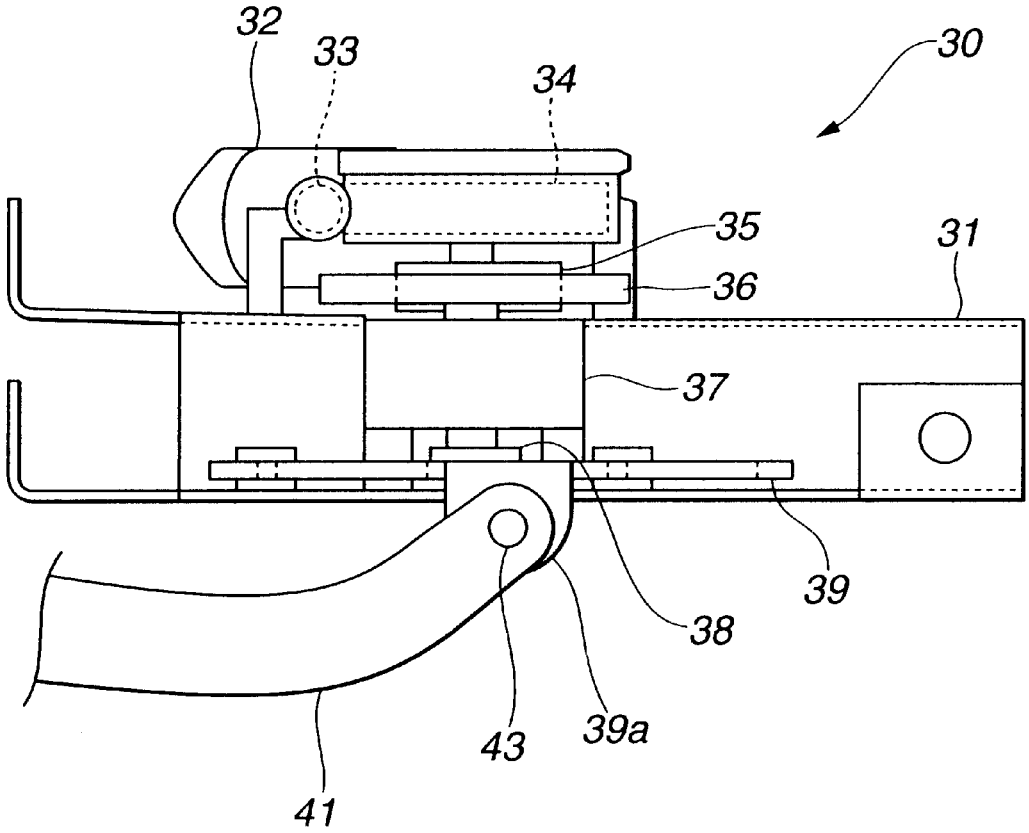
FIG. 8 is a side view illustrating the drive mechanism related to FIGS. 6 and 7.

Referring now to FIGS. 6 through 8, there is shown the detailed construction of the drive mechanism 30. The drive mechanism 30 is constructed as a sole electric-motor drive unit in which a reversible electric motor 32, reduction gears (33, 34, 35, 36), a clutch assembly 37, a pinion gear 38, and a toothed slider bar 39 are assembled with each other on a mounting bracket 31. Although it is not shown in the drawings, the motor 32 is electronically connected to a motor controller (not shown), the reversible electric motor 32 is selectively energizable in response to a control command signal from the motor controller, to power move the back door 20 in an opening direction toward the opened position and in a closing direction toward the closed position. The worm gear 33 is fixedly connected to the output shaft of the motor 32. As best seen in FIGS. 6 and 8, the worm wheel 34 is rotatably supported on the bracket 31 so that the worm wheel 34 is in meshed-engagement with the worm 33. The worm 33 and the worm wheel 34 are both accommodated in a reduction gear casing (not numbered) integrally connected to the motor housing of the motor 32. A pinion gear 35 is coaxially fixedly connected to the worm wheel 34. A gear 36 is rotatably supported on the bracket 31 nearby the pinion 35 in such a manner that the pinion 35 is brought into meshed-engagement with the gear 36 via the coupling action of the clutch 37. Usually, the clutch 37 is comprised of an electromagnetic clutch. When energized, power produced by the motor is transmitted through the motor output shaft via the worm 33, the worm wheel 34, the pinion 35, the gear 36, the clutch 37, and another pinion 38 to the toothed slider bar (the slider) 39. The pinion 38 is coaxially fixedly connected to the gear 36. The pinion 38 is permanently in meshed-engagement with a toothed slider bar 39 (which will be hereinafter referred to simply as a "slider"), in a manner so as to convert a rotary motion of the pinion gear 38 into a reciprocating motion of the slider 39. The slider 39 is slidably supported on the bracket 31 so that forward and backward strokes of the slider 39 can be permitted within a predetermined stroke range.

Figure 2:
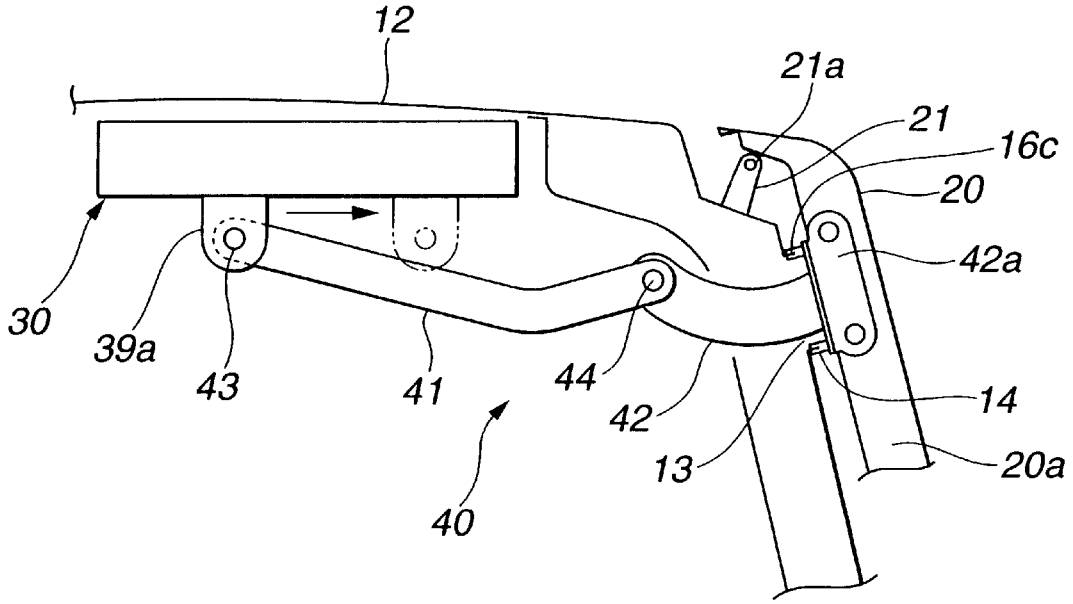
FIG. 2 is a longitudinal cross-section explaining the power opening movement of the back door from its fully-closed position in the apparatus of the embodiment.

Returning to FIGS. 2 and 3, the power-transmission mechanism 40 has a link 41 which is rotatably connected at one end (the front part) to the slider 39, and a driven arm member 42 whose end is in pin-connection with the other end (the backward part) of the link 41 for relative rotation of the other end of the link 41 about the connecting pin 44. That is to say, the forward part of the link 41 is rotatably connected to the tab-like link-end support portion 39*a* slightly projected from the bottom face of the toothed slider bar 39 by means of the connecting pin 43, whereas the backward part of the link 41 is rotatably connected to the arm end of the driven arm member 42 by means of the connecting pin 44. An arm mounting bracket 42*a* is integrally connected to or integrally formed with the driven arm member 42 to form a driven arm assembly. The arm mounting bracket 42*a* is fixedly connected to the upper portion of the right-hand side wall (or the right-hand side frame) 20*a* of the back door panel (or the back door body) by way of arm-mounting-bracket attaching screws or bolts. As clearly shown in FIG. 3, when the back door 20 is held at its full-open position, the going-in-and-out power-transmission linkage portion (that is, the driven arm member 42 itself and the backward part of the link 41) is maintained in the exterior of the vehicle compartment. As shown in FIG. 2, when the back door 20 is held at its fully-closed position, the backward half of the driven arm member 42, connecting with the arm mounting bracket 42*a*, is positioned or concealed within the through-opening 13. The driven arm member 42 (included in the going-in-and-out power-transmission linkage portion) is curved with a predetermined curvature (a predetermined radius-of-curvature R) in its longitudinal direction, and contoured and dimensioned so that the centroid of the driven arm member 42, extending in the longitudinal direction of the arm member 42, turns on the predetermined radius-of-curvature R substantially corresponding to the distance between the longitudinally-extending centroid of the arm member 42 and the axis of a hinge pin 21*a* (serving as an axis of rotation for the back door) of the door hinge 21 both during the upward pivotal movement and the downward pivotal movement of the back door 20. This minimizes an opening area (specifically, a diametrical opening area) of the through-opening 13 through which the arm member 42 passes during power movement of the back door. As appreciated from FIGS. 2, 3, and 9, the through-opening 13 is defined by an opening (an elliptical slot) formed in the inner body panel 17 of the rear end of the vehicle body and an opening (an elliptical slot) formed in the outer body panel 16 of the rear end of the vehicle body. Exactly speaking, the elliptical slot formed in the outer body panel 16 is defined in a substantially elliptical outwardly flanged portion 16*c*. In other words, the elliptical slot portion of the outer body panel 16 has the substantially elliptical outwardly flanged portion 16*c* slightly extending outwards from its inner periphery. The substantially elliptical outwardly flanged portion 16*c* is effective to prevent the entrance of rain or outside air into the vehicle compartment. Also, the outer body panel 16 has a seal member 14 (a sealing device) fitted onto the outwardly flanged portion 16*c* all around the entire circumference of the flanged portion 16*c* and properly compressing when the back door reaches a fully closed position, in order to ensure proper fit between the seal member 14 and the inner peripheral wall of the back door panel with the back door held at the fully-closed position. The use of the seal member 14 is more effective to prevent the entrance of rain (water or moisture) or dust into the vehicle compartment or into the internal space defined between the outer body panel 16 and the inner body panel 17. The seal member functions as a water-tight plus dust seal.

The operation of the power door operating apparatus of the embodiment is hereunder described in reference to FIGS. 2, 3, 4 and 5.

Figure 3:
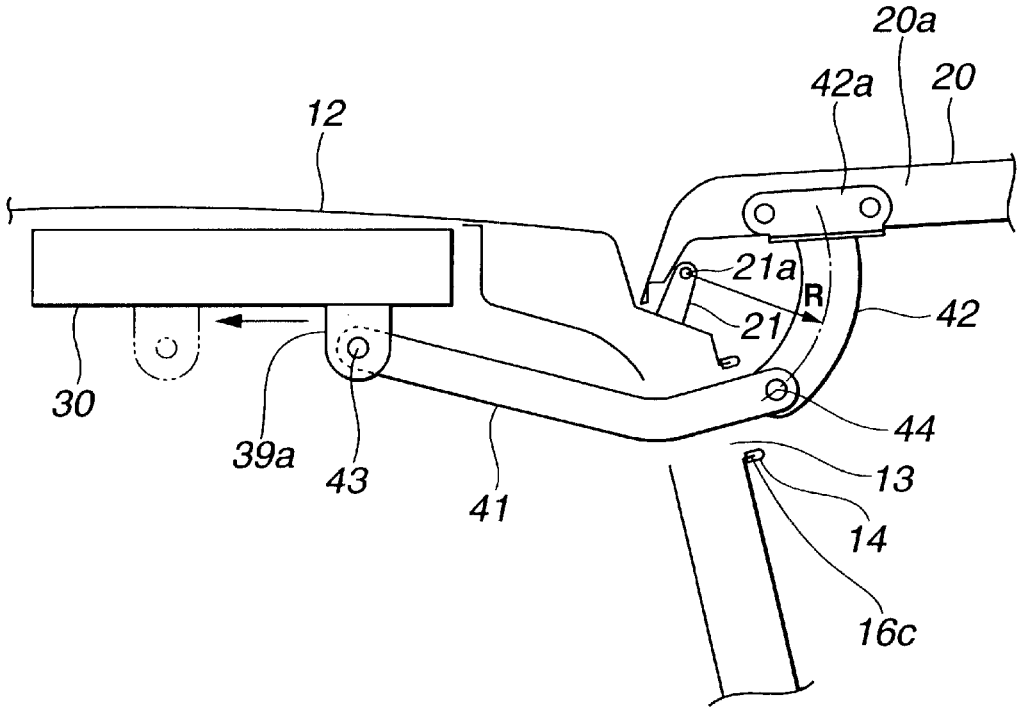
FIG. 3 is a longitudinal cross-section explaining the power closing movement of the back door from its full-open position in the apparatus of the embodiment.
Figure 4:
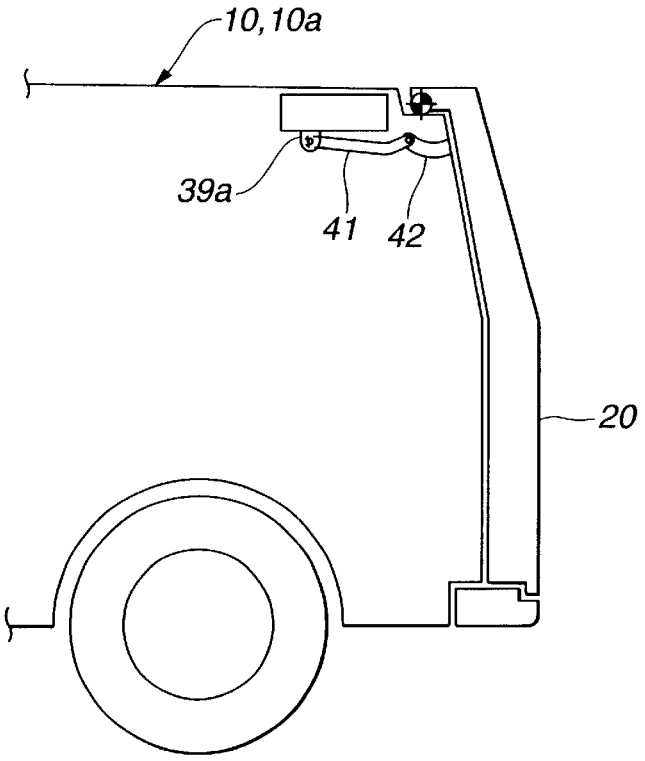
FIG. 4 is a schematic view of the rear end of the vehicle showing a state of a linkage (including a tab-like link-end support portion 39*a* of a toothed slider bar 39, a link 41, and a driven arm member 42) with the back door kept at the fully-closed position.
Figure 5:
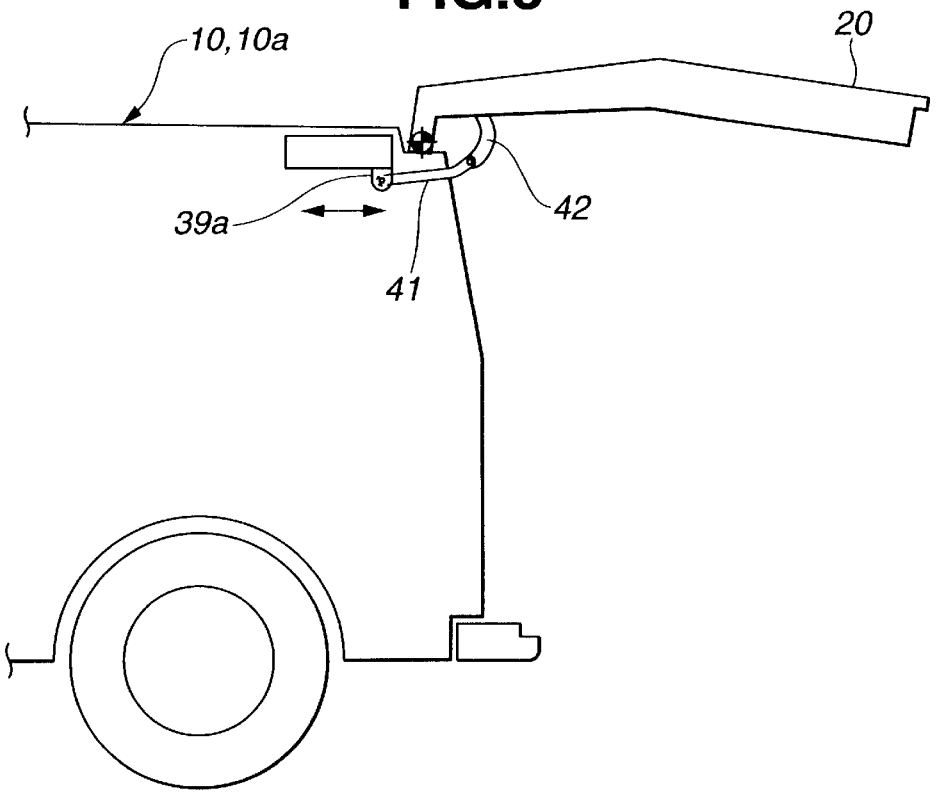
FIG. 5 is a schematic view of the rear end of the vehicle showing a state of the linkage (including the tab-like link-end support portion 39*a* of the toothed slider bar 39, the link 41, and the driven arm member 42) with the back door kept at the full-open position.

FIGS. 2 and 4 show the fully-closed state of the back door 20. Under this condition, to power the back door 20 open, the reversible electric motor 32 of the drive mechanism 30 is rotated in its normal-rotation direction. With the normal rotation of the motor 32, the tab-like link-end support portion 39*a* of the slider 39 moves backwards as indicated by the arrow of FIG. 2. During the backward movement of the tab-like link-end support portion 39*a* of the slider 39, the driven arm member 42 is pushed backwardly through the link 41, and thus the arm member 42 rotates in the counterclockwise direction (viewing FIG. 2) about the hinge pin 21*a* together with the back door 20. As a result, the back door 20 swings up and reaches the fully opened position shown in FIGS. 3 and 5. In the full open state, the back door 20 is held at the full-open position by means of a so-called door support assembly (not shown) such as a gas-filled cylinder (often called a "gas stay"). In the full-open state of the back door 20 as shown in FIG. 3, the going-in-and-out power-transmission linkage portion (almost the rear half of the power-transmission mechanism 40) is carried and kept in the exterior of the vehicle compartment. The going-in-and-out power-transmission linkage portion of the power-transmission mechanism 40 passes through the through-opening 13, arranged outside of the inner peripheral edge of the door opening 11 and formed in the intersection between the rear roof drip rail portion 16*a* of the outer body panel 16 and the rear pillar drip rail portion 16*b* (or the rear quarter panel). As discussed above, according to the apparatus of the embodiment, the going-in-and-out power-transmission portion of the power-transmission mechanism 40 (that is, the arm member 42 and the backward part of the link 41) never moves along the inside of the inner peripheral edge of the door opening 11. The going-in-and-out power-transmission portion of the power-transmission mechanism 40 can move along the outside of the inner peripheral edge of the door opening 11, while passing through the through-opening 13. As a consequence, the power door operating device of the embodiment ensures as wide an effective door-opening area of the door opening 11 as possible. Hitherto, part of the door opening was used as a passage for the linkage of the power-transmission mechanism, while somewhat reducing or sacrificing the door opening area. The relatively wider door-opening area of the door opening 11, realized by the power door operating apparatus of the embodiment, enhances the work efficiency during loading and unloading through the door opening 11.

In contrast to the above, when the power closing of the back door is initiated, the reversible motor 32 is rotated in its reverse-rotation direction. With the reverse rotation of the motor 32, the tab-like link-end support portion 39*a* of the slider 39 moves forwards as indicated by the arrow of FIG. 3. During the forward movement of the tab-like link-end support portion 39*a* of the slider 39, the driven arm member 42 is pulled forwardly, and thus the arm member 42 rotates in the clockwise direction (viewing FIG. 3) about the hinge pin 21*a*. As a result, the back door swings down and reaches the fully closed position shown in FIGS. 2 and 4. In the fully closed state, the back door 20 is held at the fully-closed position by means of a door lock mechanism (not shown). As a matter of course, it is possible to reduce an operating physical force needed to open or close the back door by virtue of the previously-noted gas-filled cylinder, often called "gas stay", (not shown) provided between the vehicle body and the vehicle door. This contributes to reduction of design power of the drive mechanism of the vehicle-door power operating apparatus, and thus the overall dimension of the power operating apparatus as well as the size of the drive mechanism can be small-sized.

Figure 9:
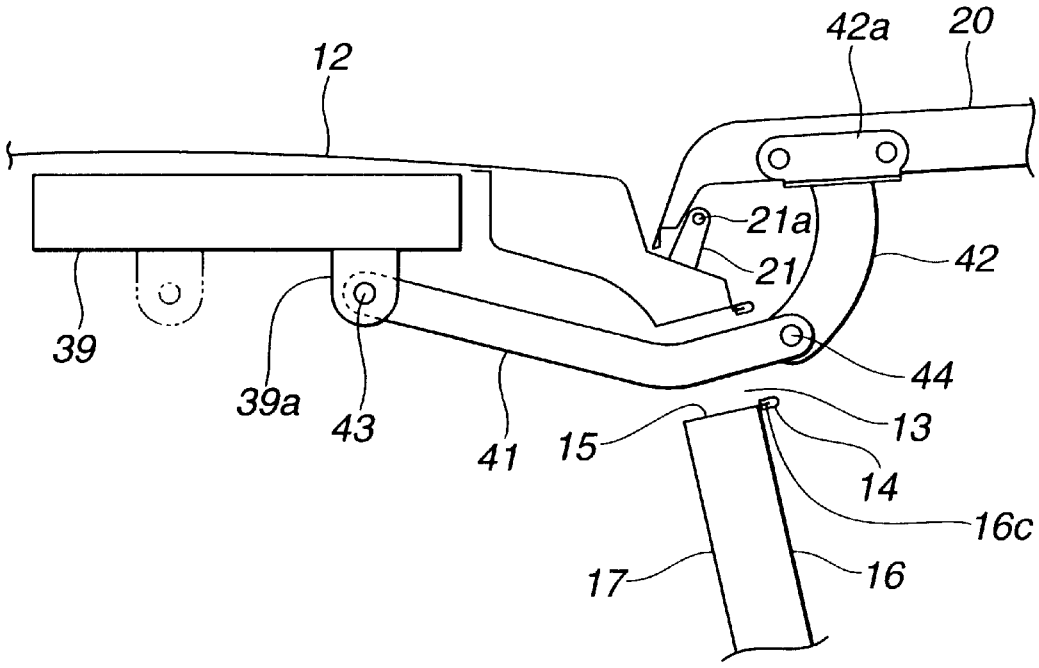
FIG. 9 is a longitudinal cross-sectional view illustrating a modified power door operating apparatus with the back door kept at the fully-opened position.

Referring now to FIG. 9, there is shown a longitudinal cross-section of the modified power door operating apparatus. The modified apparatus of FIG. 9 is slightly different from the apparatus of FIGS. 2 and 3, in that a substantially cylindrical reinforcement (or a substantially cylindrical stiffener) 15 is further provided all around the inner periphery of the through-opening 13. As seen in FIG. 9, the substantially-cylindrical reinforcement 15 is formed in such a manner as to continually connect the elliptical slot of the outer body panel 16 with the elliptical slot of the inner body panel 17. The reinforcement 15 is effective to partly increase a rigidity of the panel structure at and near the circumference of the through-opening 13. The reinforcement 15 also functions as a linkage guide-sleeve for the power-transmission mechanism 40. Additionally, the reinforcement 15 serves to prevent dust or rain from entering the internal space defined between the outer body panel 16 and the inner body panel 17.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. In a vehicle:

a vehicle body to which a vehicle door is operatively attached so as to be moveable between an open position and a closed position, the vehicle body having inner and outer body panels whose inner peripheral edge portions define a door opening which is closed by the vehicle door; and a power operating apparatus arrangement, the power operating apparatus arrangement comprising:

a drive mechanism provided inside the vehicle body with respect to the door opening to move the vehicle door in an opening direction toward the opened position and in a closing direction toward the closed position;

a power-transmission mechanism mechanically linking the drive mechanism with the vehicle door to enable power transmission between the drive mechanism and the vehicle door;

means for defining a through-opening in the inner and outer body panels of the vehicle body so that the through-opening is arranged outside of the door opening defined by the inner peripheral edge portions of the inner and outer body panels;

said power-transmission mechanism having at least a linkage portion capable of moving in and out of an interior of the vehicle body, the linkage portion of said power-transmission mechanism being disposed through the through-opening, so that a locus of power movement of the linkage portion of said power-transmission mechanism is generated outside of the door opening defined by the inner peripheral edge portions of the inner and outer body panels.

2. The power operating apparatus arrangement as claimed in claim 1, wherein the linkage portion of said power-transmission mechanism is curved with a predetermined curvature in a longitudinal direction of the linkage portion, and contoured and dimensioned so that a centroid of the linkage portion, extending in the longitudinal direction, turns on a predetermined radius of curvature substantially corresponding to a distance between the centroid of the linkage portion and an axis of rotation for the vehicle door during power movement of the vehicle door.

3. In a vehicle:

a vehicle body to which a vehicle door is operatively attached so as to be moveable between an open position and a closed position, the vehicle body having inner and outer body panels whose inner peripheral edge portions define a door opening of the vehicle door;

a drive mechanism provided inside the vehicle body with respect to the door opening to drive the vehicle door in an opening direction toward the open position and in a closing direction toward the closed position;

a power-transmission mechanism mechanically linking the drive mechanism with the vehicle door to enable drive transmission between the drive mechanism and the vehicle door;

means for defining a through-opening in the inner and outer body panels of the vehicle body so that the through-opening is arranged outside of the door opening defined by the inner peripheral edge portions of the inner and outer body panels;

said power-transmission mechanism having at least a linkage portion capable of going into and out of an interior of the vehicle body;

the linkage portion of said power-transmission mechanism being inserted into the through-opening, so that a locus of power movement of the linkage portion of said power-transmission mechanism is generated outside of the door opening defined by the inner peripheral edge portions of the inner and outer body panels; and a seal member provided along an inner periphery of the through-opening all around an entire circumference of the through opening to prevent dust and moisture from entering the interior of the vehicle body through the through-opening.

4. The power operating apparatus arrangement as claimed in claim 1, which further comprises a reinforcement provided along an inner periphery of the through-opening to partly enhance a rigidity of the body panel at and near the through-opening.

5. The power operating apparatus arrangement as claimed in claim 1, wherein said drive mechanism has a slider disposed in the interior of the vehicle body and an electric motor initiating a reciprocating motion of the slider, and said power-transmission mechanism has a link rotatably connected at one link end to the slider, and an arm rotatably connected at one arm end to another link end of the link and fixedly connected at another arm end to the vehicle door, and the arm substantially corresponds to the linkage portion of said power-transmission mechanism, capable of going into and out of the interior of the vehicle body.

6. The power operating apparatus arrangement as claimed in claim 5, wherein said drive mechanism is mounted on an inner peripheral wall of a roof panel of the vehicle body.

7. In a vehicle:

a vehicle body to which a back door is operatively attached so as to be movable between an opened position and a closed position, the vehicle body having inner and outer body panels whose inner peripheral edge portions define a door opening of the back door;

an electric drive mechanism provided at an inside of the vehicle body with respect to the door opening and including an electric motor selectively energizable to move the back door in an opening direction toward the opened position and in a closing direction toward the closed position;

a power-transmission mechanism mechanically linking the drive mechanism with the back door to enable power transmission between the drive mechanism and the back door;

means for defining a through-opening in the inner and outer body panels of the vehicle body near an intersection between an upper roof rail portion and a rear pillar drip rail portion so that the through-opening is arranged outside of the door opening defined by the inner peripheral edge portions of the inner and outer body panels;

said power-transmission mechanism having at least a linkage portion capable of going into and out of an interior of the vehicle body;

the linkage portion of said power-transmission mechanism being inserted into the through-opening, so that a locus of power movement of the linkage portion of said power-transmission mechanism is generated outside of the door opening defined by the inner peripheral edge portions of the inner and outer body panels.

8. The vehicle as claimed in claim 7, wherein the linkage portion of said power-transmission mechanism is curved with a predetermined curvature in a longitudinal direction of the linkage portion, and contoured and dimensioned so that a centroid of the linkage portion, extending in the longitudinal direction, turns on a predetermined radius of curvature substantially corresponding to a distance between the centroid of the linkage portion and an axis of rotation for the back door during power movement of the back door to minimize an opening area of the through-opening.

9. The vehicle as claimed in claim 8, wherein the through-opening has an outwardly flanged portion extending outwards from an inner periphery of the through-opening, and which further comprises a seal member fitted onto the outwardly flanged portion around an entire circumference of the outwardly flanged portion to prevent dust and moisture from entering the interior of the vehicle body through the through-opening.

10. In a vehicle:

a vehicle body to which a back door is operatively attached so as to be movable between an open position and a closed position, the vehicle body having inner and outer body panels whose inner peripheral edge portions define a door opening of the back door;

an electric drive mechanism provided inside the vehicle body with respect to the door opening and including an electric motor selectively energizable to power move the back door in an opening direction toward the opened position and in a closing direction toward the closed position;

a power-transmission mechanism mechanically linking the drive mechanism with the back door to enable power transmission between the drive mechanism and the back door;

means for defining a through-opening in the inner and outer body panels of the vehicle body near an intersection between an upper roof rail portion and a rear pillar drip rail portion so that the through-opening is arranged outside of the door opening defined by the inner peripheral edge portions of the inner and outer body panels;

said power-transmission mechanism having at least a linkage portion capable of going into and out of an interior of the vehicle body;

the linkage portion of said power-transmission mechanism being inserted into the through-opening, so that a locus of power movement of the linkage portion of said power-transmission mechanism is generated outside of the door opening defined by the inner peripheral edge portions of the inner and outer body panels;

the linkage portion of said power-transmission mechanism being curved with a predetermined curvature in a longitudinal direction of the linkage portion, and contoured and dimensioned so that a centroid of the linkage portion, extending in the longitudinal direction, turns on a predetermined radius of curvature substantially corresponding to a distance between the centroid of the linkage portion and an axis of rotation for the back door during power movement of the back door to minimize an opening area of the through-opening; and a reinforcement provided along an inner periphery of the through-opening to partly enhance a rigidity of the inner and outer body panels at and near the through-opening, the inner body panel having an elliptical slot and the outer body panel having an elliptical slot, the reinforcement formed as a substantially cylindrical reinforcement connecting the elliptical slot of the inner body panel with the elliptical slot of the outer body panel, and said means for defining the through-opening comprising the elliptical slot formed in the inner body panel, the elliptical slot formed in the outer body panel, and the substantially cylindrical reinforcement, and the substantially cylindrical reinforcement serving as a guide sleeve for the linkage portion of said power-transmission mechanism.

11. In a vehicle:

a hinged back door moveable between an open position and a closed position;

a vehicle body to which the back door is operatively attached, the vehicle body having inner and outer body panels whose inner peripheral edge portions define a door opening of the back door; and an electric drive mechanism provided inside of the vehicle body with respect to the door opening and including an electric motor selectively energizable to move the back door in an opening direction toward the opened position and in a closing direction toward the closed position;

a power-transmission mechanism mechanically linking the drive mechanism with the back door to enable power transmission between the drive mechanism and the back door;

means for defining a through-opening in the inner and outer body panels of the vehicle body near an intersection between an upper roof rail portion and a rear pillar drip rail portion so that the through-opening is arranged outside of the door opening defined by the inner peripheral edge portions of the inner and outer body panels;

said power-transmission mechanism having at least a linkage portion capable of moving in and out of an interior of the vehicle body;

the linkage portion of said power-transmission mechanism being disposed through the through-opening, so that a locus of power movement of the linkage portion of said power-transmission mechanism is generated outside of the door opening defined by the inner peripheral edge portions of the inner and outer body panels;

the linkage portion of said power-transmission mechanism being curved with a predetermined curvature in a longitudinal direction of the linkage portion, and contoured and dimensioned so that a centroid of the linkage portion, extending in the longitudinal direction, turns on a predetermined radius of curvature substantially corresponding to a distance between the centroid of the linkage portion and an axis of rotation for the back door during power movement of the back door to minimize an opening area of the through-opening;

said drive mechanism having a slider disposed in the interior of the vehicle body and an electric motor initiating a sliding motion of the slider;

said power-transmission mechanism having:

a link rotatably connected at one link end to the slider; and an arm rotatably connected at one arm end to another link end of the link and fixedly connected at another arm end to the vehicle door, the arm forming at least a portion of the linkage portion of said power-transmission mechanism, capable of moving in and out of the interior of the vehicle body;

a hinge pin whose axis corresponding to the axis of rotation for the back door;

a first pin via which the sliding motion of the slider is transmitted to the link; and a second pin via which a motion of the link is converted into a rotary motion of the arm about the hinge pin to cause a pivotal movement of the back door.

* * * * *